US007641277B2

(12) United States Patent
Lawson et al.

(10) Patent No.: US 7,641,277 B2
(45) Date of Patent: Jan. 5, 2010

(54) ZERO-WALL CLEARANCE LINKAGE MECHANISM FOR A HIGH-LEG SEATING UNIT

(75) Inventors: Gregory Mark Lawson, Saltillo, MS (US); Robert Dean Donovan, Mooreville, MS (US)

(73) Assignee: L & P Property Management Co., South Gate, CA (US)

( * ) Notice: Subject to any disclaimer, the term of this patent is extended or adjusted under 35 U.S.C. 154(b) by 0 days.

(21) Appl. No.: 11/968,380

(22) Filed: Jan. 2, 2008

(65) Prior Publication Data

US 2009/0174251 A1 Jul. 9, 2009

(51) Int. Cl.
*A47C 1/02* (2006.01)

(52) U.S. Cl. ..... 297/85 L

(58) Field of Classification Search ..... 297/85 L, 297/85 R, 84, 89, 90

See application file for complete search history.

(56) References Cited

U.S. PATENT DOCUMENTS

| | | | | | |
|---|---|---|---|---|---|
| 3,243,226 | A | * | 3/1966 | Katz | 297/85 R |
| 3,880,462 | A | * | 4/1975 | Mednick | 297/84 |
| 3,958,827 | A | * | 5/1976 | Re | 297/61 |
| 4,185,869 | A | | 1/1980 | Rogers, Jr. | |
| 4,188,062 | A | | 2/1980 | Rogers, Jr. | |
| 4,216,992 | A | * | 8/1980 | Crum | 297/85 R |
| 4,226,469 | A | | 10/1980 | Rogers, Jr. | |
| 4,249,772 | A | | 2/1981 | Rogers, Jr. | |
| 4,337,977 | A | | 7/1982 | Rogers, Jr. | |
| 4,350,386 | A | | 9/1982 | Rogers, Jr. | |
| 4,350,387 | A | | 9/1982 | Rogers, Jr. | |
| 4,418,957 | A | | 12/1983 | Rogers, Jr. | |
| 4,531,778 | A | | 7/1985 | Rogers, Jr. | |
| 5,110,179 | A | * | 5/1992 | Rogers | 297/68 |
| 5,271,660 | A | * | 12/1993 | LaPointe et al. | 297/85 L |
| 5,570,927 | A | * | 11/1996 | LaPointe et al. | 297/85 L |
| 6,089,660 | A | * | 7/2000 | Sproule | 297/232 |
| 6,540,291 | B2 | * | 4/2003 | Hoffman et al. | 297/85 R |
| 6,793,279 | B2 | * | 9/2004 | Hoffman et al. | 297/84 |
| 6,945,599 | B2 | * | 9/2005 | May | 297/270.1 |
| 7,147,278 | B2 | * | 12/2006 | Johnson et al. | 297/85 R |
| 7,445,279 | B2 | * | 11/2008 | Crum | 297/84 |
| 2002/0149238 | A1 | * | 10/2002 | Hoffman et al. | 297/85 |
| 2003/0015893 | A1 | * | 1/2003 | Hoffman et al. | 297/85 |
| 2008/0111402 | A1 | * | 5/2008 | Crum | 297/85 |

* cited by examiner

*Primary Examiner*—David Dunn
*Assistant Examiner*—James Alex
(74) *Attorney, Agent, or Firm*—Shook, Hardy & Bacon LLP

(57) ABSTRACT

A seating unit that includes a linkage mechanism adapted to move the seating unit between extended and reclined positions, and a chassis is provided. The linkage mechanism includes a seat-mounting link, a base plate fixedly mounted to the chassis, a back-mounting bracket rotatably coupled to the seat-mounting link, a back drive link in generally laterally-spaced relation to the seat-mounting link, and a front-lift assembly that is rotatably coupled to the seat-mounting link. In operation, a rearward occupant force on the back-mounting bracket generates a rearward bias that is converted to a laterally-directed force through the back drive link to the front-lift assembly. Upon receiving this force, the front-lift assembly translates the seat-mounting link forward and upward in relation to the base plate, such that, the seat-mounting link is consistently biased in a particular inclination angle with respect to the base plate throughout adjustment.

9 Claims, 14 Drawing Sheets

ZERO-WALL CLEARANCE LINKAGE MECHANISM FOR A HIGH-LEG SEATING UNIT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit (e.g., high-leg chairs with T-cushion styling), which is otherwise limited by the configurations of linkage mechanisms in the field. Additionally, the improved linkage mechanism of the present invention provides for reclining a seating unit that is positioned against a wall.

Reclining seating units exist that allow a user to forwardly extend a footrest and to recline a backrest rearward relative to a seat. These existing seating units typically provide three basic positions: a standard, non-reclined closed position; an extended position; and a reclined position. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, these seating units require relatively complex linkage mechanisms to afford this capability. The complex linkage assemblies limit certain design aspects utilized by furniture manufacturers. In particular, these linkage assemblies impose constraints on an upholstery designer's use of multiple styling features concurrently on an adjustable seating unit. For instance, the linkage assemblies are bulky and require seating units to incorporate space-saving utilities such as connecting the linkage mechanisms between the arms to a base on the floor in order to accomplish hiding the linkage assembly below the seat in the closed position. But, this configuration precludes a furniture designer from providing the seating unit with arms that rest either directly or indirectly, through support of high legs, on an underlying surface. Further, if the linkage assembly is configured as a more compact apparatus that resides between the legs and the seat, the furniture designer is restricted from incorporating a pivot-over-arm feature that allows for winged backs on the backrest due to interference between the arms and the winged backs when reclining. Still further, other existing seating units that provide winged backs on the seatback are precluded from providing a T-cushion style seat by the structure of the linkage assembly (i.e., lacking the ability to laterally adjust the set between the arms of the seating unit). As such, upholstery designers are forced to choose between styling options. Moreover, upholstery styling designers are forced to purchase and stock many different linkage mechanisms if each option is to be produced within the seating unit line.

In addition, the lack of lateral adjustment offered by these complex linkage mechanisms disadvantageously requires the entire seating unit to be moved outwardly away from an adjacent wall. Otherwise, without substantial clearance between the seatback and the adjacent wall, the backrest in the reclined position will contact the adjacent wall.

The present invention pertains to a novel linkage mechanism that allows a seating unit to provide all of the following features: a T-cushion style seat, a winged back on the backrest that pivots over the arms without interfering therewith, a space-saving utility that overcomes the need for considerable wall clearance, and high-leg capability. Significantly, the linkage mechanism of the invention is constructed in a simple and compact arrangement in order to provide function without impairing incorporation of desirable upholstery features. Further, the present invention allows for a wide variety of styling options that may be applied to the seating unit in which it is installed.

BRIEF SUMMARY OF THE INVENTION

Accordingly, the present invention seeks to provide a simplified, compact, linkage mechanism which can be adapted to essentially any type of seating unit.

Generally, the novel seating unit includes the following components: a first foot-support ottoman; a chassis that has a pair of base plates in substantially parallel-spaced relation and at least one crossbeam spanning the base plates; a pair of seat-mounting links in substantially parallel-spaced relation, a seating support surface extending between the seat-mounting links; and a pair of the generally mirror-image linkage mechanisms that interconnect the base plates to the seat-mounting links. Additionally, the seat-mounting links are disposed in an inclined orientation in relation to the chassis. In operation, the linkage mechanisms are adapted to move between a closed position, an extended position, and a reclined position. Typically, the linkage mechanisms include a pair of ottoman assemblies that movably interconnect the first foot-support ottoman to the seat-mounting links, and a pair of roller systems. In particular, the roller systems are adapted to translate the seat-mounting links over the base plates via a roller and inclined track during adjustment between the closed position, the extended position, and the reclined position. In embodiments, the roller systems translate the seat-mounting links while maintaining their inclined orientation relationship to the chassis such that the seating support surface is biased at a particular inclination angle throughout adjustment.

In embodiments, the ottoman assembly includes a set of linkages that are adapted to collapse to the closed position such that the set of linkages are located below the seating support surface and above a lower surface of a crossbeam support. This collapsed configuration reduces the set of linkages to a compact size such that the seating unit can incorporate high legs (e.g., legs of a traditional chair) while still hiding the linkage mechanism in the closed position.

In other embodiments, the seating unit includes a pair of opposed arms that each have an arm-support surface. The opposed arms are operably coupled to the seat-mounting links such that during adjustment between the closed position, the extended position, and the reclined position, the arm-support surfaces of the opposed arms are maintained in a consistent substantially-horizontal orientation.

In yet another embodiment, the linkage mechanism further includes the following components: a pair of back-mounting brackets rotatably coupled to the seat-mounting links and fixedly attached to a backrest; a pair of back-drive links in generally laterally-spaced relation to the seat-mounting links and pivotably coupled to the back-mounting brackets; and a pair of front-lift assemblies rotatably coupled to the seat-mounting links. Generally, the front lift assemblies operably couple the back-drive links to the base plates. In operation, when adjusting between the extended and the reclined positions, the seat-mounting links are translated forward and upward in relation to the base plates which are directed by the front-lift assemblies. Accordingly, the seat-mounting links remain biased in a particular inclination angle with respect to the chassis throughout adjustment.

Still further, in another embodiment of the present invention, the linkage mechanism has footrest mechanisms. Generally, the footrest mechanisms include the following elements: a pair of footrest lock brackets that are fixedly attached to extending ends of a drive tube; a pair of footrest lock links that are pivotably coupled footrest lock brackets; a pair of extension-resistant devices interconnecting the seat-mounting links to the footrest lock links; and a pair of over-center axes that radially extend from a longitudinal axis of the drive tube. In one instance, the over-center axes reside in perpendicular-spaced relation with the extension-resistive devices. In use, the extension-resistive devices resist motion of the ottoman assemblies in the extended position and assist collapse of the ottoman assemblies to the closed position, incident to the pivot locations passing rearwardly across the over-center axes.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
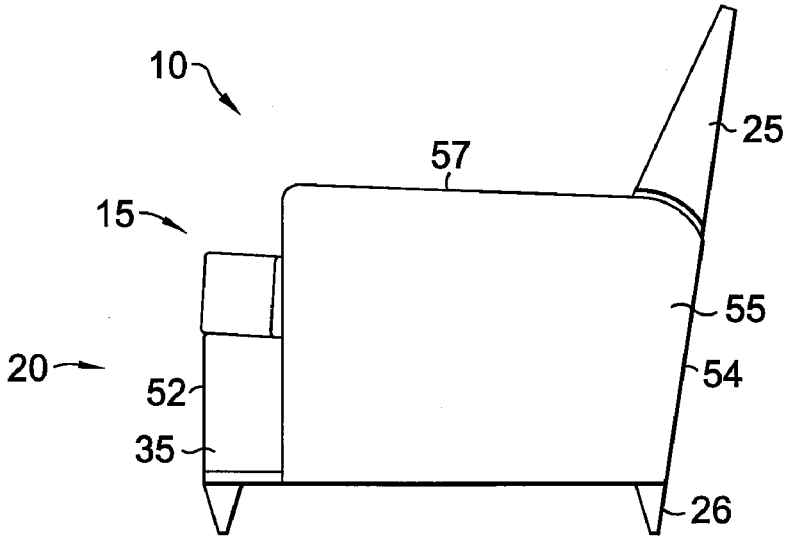
FIG. 1 is a diagrammatic lateral view of a seating unit in a closed position, in accordance with an embodiment of the present invention.

FIGS. 1-4 illustrate a seating unit 10. Seating unit 10 has a seat 15, a backrest 25, legs 26, a linkage mechanism 100, a first foot-support ottoman 45, a leg-support ottoman 47, a stationary base 35, and a pair of opposed arms 55. Stationary base 35 has a forward section 52, a rearward section 54 and is supported by the legs 26, where the legs 26 support the stationary base 35 and raise it above an underlying surface (not shown). In addition, the stationary base 35 supports the seat 15 via the linkage mechanism 100 that is generally disposed between the pair of opposed arms 55, and the rearward section 54. Seat 15 may comprise a T-cushion style seat that is moveable over the stationary base 35 during adjustment of the seating unit 10. In embodiments, the T-cushion style seat is moveable according to the arrangement of the linkage mechanism 100 such that no portion of the T-cushion style seat interferes with the opposed arms 55 throughout adjustment.

Figure 3:
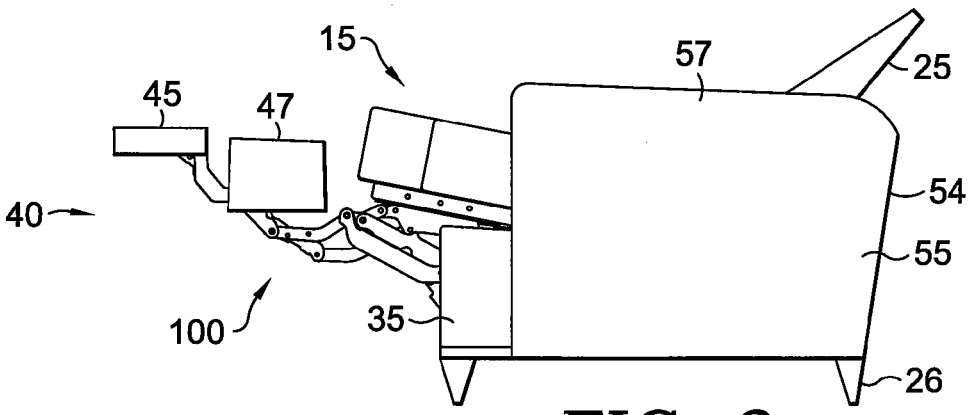
FIG. 3 is a view similar to FIG. 1, but in a reclined position with opposed arms attached to a stationary base, in accordance with an embodiment of the present invention.
Figure 4:
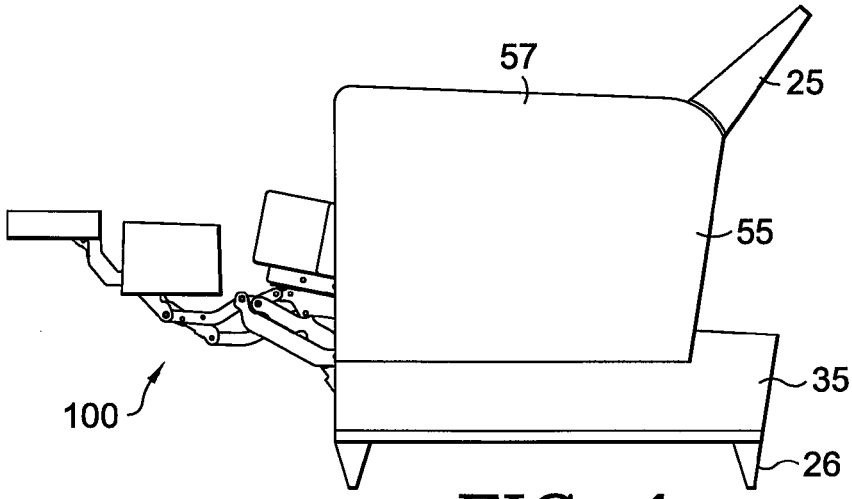
FIG. 4 is a view similar to FIG. 1, but in the reclined position with the opposed arms attached to a linkage mechanism, in accordance with an embodiment of the present invention.

Opposed arms 55 are laterally spaced and have an arm-support surface 57 that is orientated substantially horizontally. In one embodiment, the pair of opposed arms 55 are attached to the stationary base via intervening members, as illustrated in FIG. 3. In another embodiment, the pair of opposed arms are attached to the linkage mechanism 100, as illustrated in FIG. 4. The backrest 25 extends from the rearward section 54 of the stationary base 35 and is rotatably coupled to the linkage mechanism 100, typically proximate to the arm-support surface 57. First foot-support ottoman 45 and the leg-support ottoman 47 are moveably supported by the linkage mechanism 100. The linkage mechanism 100 is arranged to articulably actuate and control movement of the seat 15, the back 25, and the ottomans 45 and 47 between the positions shown in FIGS. 1-4, as more fully described below.

As shown in FIGS. 1-4, the seating unit 10 is adjustable to three basic positions: a closed position 20, an extended position 30 (i.e., TV position), and the reclined position 40. FIG. 1 depicts the seating unit 10 adjusted to the closed position 20, which is a normal non-reclined sitting position with the seat 15 in a generally horizontal position and the back 25 generally upright and in a substantial perpendicular biased relation to the seat 15. In particular, the seat 15 is disposed in a slightly inclined orientation relative to the stationary base 35. This inclined orientation is maintained throughout adjustment of the seating unit 10. In addition, when adjusted to the closed position 20, the ottomans 45 and 47 are positioned below the seat 15.

Figure 2:
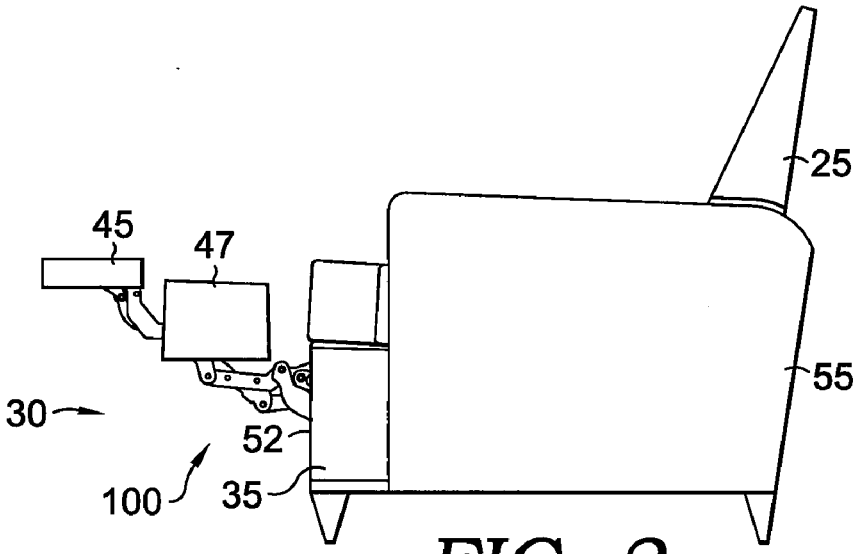
FIG. 2 is a view similar to FIG. 1, but in an extended position, in accordance with an embodiment of the present invention.

Turning to FIG. 2, the extended position 30, or TV position, will now be described. When the seating unit 10 is adjusted to the extended position, the leg support ottoman 47 and the first foot-support ottoman 45 are extended forward of the forward section 52 of the stationary base 35 and disposed generally horizontal. However, the backrest 25 remains substantially perpendicular to the seat 15 and will not encroach an adjacent wall, and the seat 15 is maintained in the inclined orientation relative to the stationary base 35. Thus, the configuration of the seating unit 10 in the extended position 30 provides an occupant a reclined TV position while providing space-saving utility. Typically, the seat 15 is translated slightly forward and upward relative stationary base 35. This independent movement of the seat 15 allows a T-cushion style seat to be used as the seat 15. Generally, the T-cushion style seat extends forward over the forward section 52 and both between and in front of opposed arms 55.

FIGS. 3 and 4 depict the reclined position 40, in which the seating unit 10 is fully reclined. With reference to FIG. 3, the opposed arms 55 are attached to the stationary base 35. In another embodiment, the legs 26 may extend downward from the opposed arms 55, instead of being attached to the stationary base 35. Accordingly, the arm-support surfaces 57 are maintained in substantially horizontal orientation. The backrest 25 is rotated rearwardly by the linkage mechanism 100 and biased in rearward inclination angle. The rearward inclination angle is an obtuse angle in relation to the seat 15. However, the rearward inclination angle of the backrest 25 is offset by a forward and upward translation of the seat 15 as controlled by the linkage mechanism 100. This is in contrast to other reclining chairs with 3-position mechanisms, which cause a backrest to move rearward, thereby requiring that the reclining chair be positioned a considerable distance from an adjacent rear wall. Thus, the translation of the seat 15 in the present invention allows for zero-wall clearance, which is a space-saving utility that permits positioning the seating unit 10 in close proximity to an adjacent rear wall. In embodiments, the ottomans 45 and 47 are moved forward and upward from their position in the extended position 30.

In another embodiment, as illustrated in FIG. 4, the opposed arms 55 translate forward and rearward relative to the stationary base 35 during adjustment. In one embodiment, the translation of the opposed arms 55 is facilitated by the linkage mechanism 100 such that the arm-support surfaces 57 are maintained in substantially horizontal orientation. Accordingly, the backrest 25 is rotated over the arm-support surfaces 57 to a rearward inclination angle thereby providing a pivot-over-arm feature. This feature allows a furniture designer to provide the backrest 25 with winged backs that will not interfere with the opposed arms 55 during adjustment of the seating unit 10.

Figure 5:
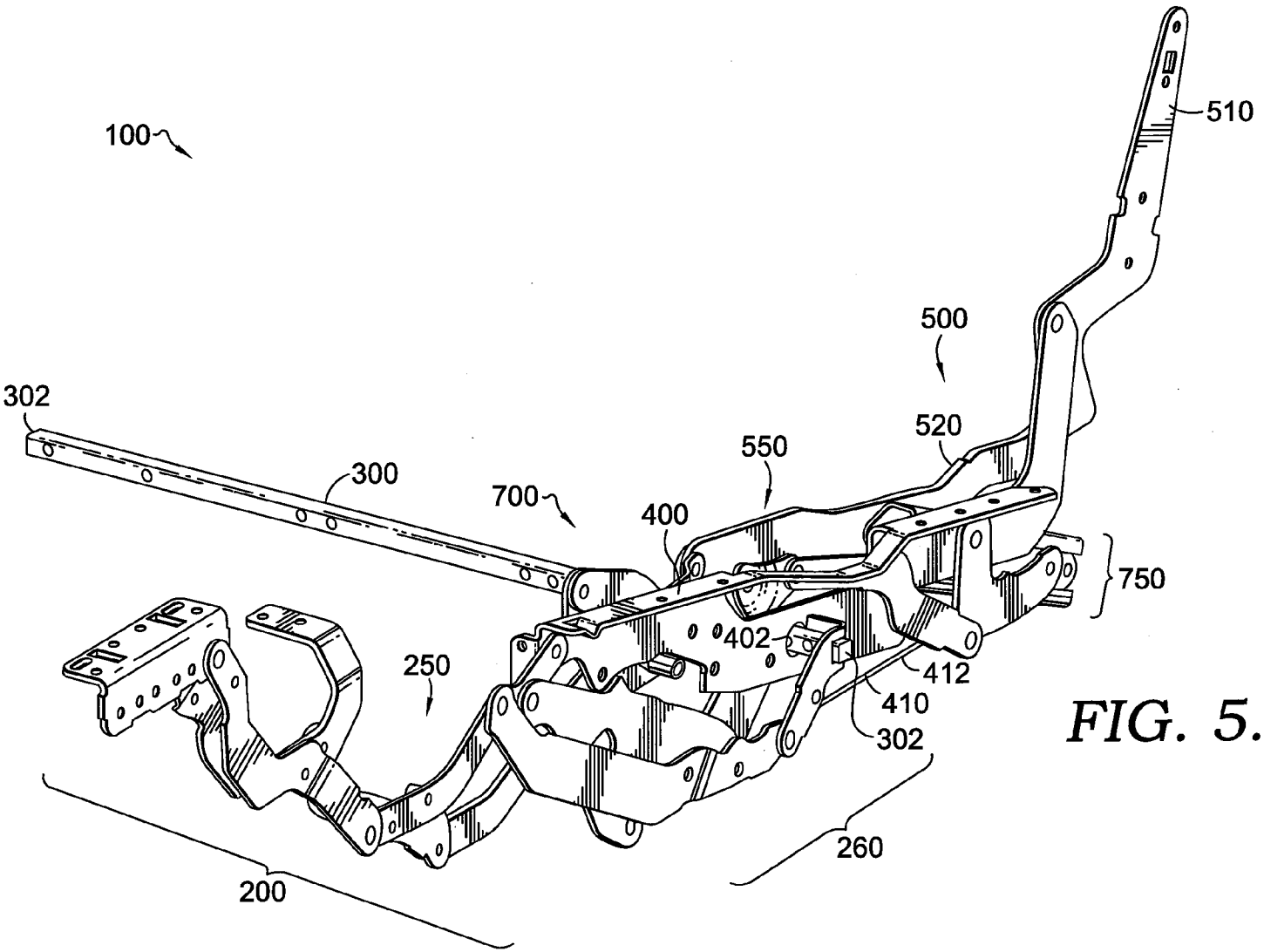
FIG. 5 is a partial perspective view of the linkage mechanism in the extended position, in accordance with an embodiment of the present invention.

Turning now to FIG. 5, the linkage mechanism 100 will now be discussed in detail. Initially, linkage mechanism 100 comprises a plurality of linkages that are arranged to actuate and control movement of the seating unit during movement between the closed, the extended, and the reclined position. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the linkage mechanism 100 guides the rotational movement of the backrest 25 and the translational movement of the seat 15, in relation to the stationary base 35 (see FIGS. 1-4). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the seating unit 10 between the pair of opposed arms 55 (see FIGS. 1-4). As such, the ensuing discussion will focus on only one of the linkage mechanisms 100, with the content being equally applied to the other linkage assembly.

With continued reference to FIG. 5, a partial perspective view of the linkage mechanism 100 in the extended position is shown, in accordance with an embodiment of the present invention. In embodiments, the linkage mechanism 100 includes a footrest mechanism 200, a seat-mounting link 400, a base plate 410, a recliner mechanism 500, and a seat-adjustment mechanism 700. Footrest mechanism 200 is comprised of a plurality of links arranged to extend and collapse the ottomans 45 and 47 (see FIGS. 1-4) during adjustment of the seating unit from the extended position to the closed position, respectively. In addition, the footrest mechanism 200 includes an ottoman assembly 250 and an actuation assembly 260, as more fully discussed below with reference to FIGS. 6-8. Seat-mounting link 400 is configured to fixedly mount to a seat (e.g., T-cushion style seat) and in conjunction with an opposed seat-mounting link, define a seat support surface (not shown). In embodiments, the seat support surface extends between the pair of seat-mounting links and is disposed in a particular inclination angle throughout adjustment of the seating unit. In one instance, the seat-mounting link 400 is maintained in an inclined orientation relationship to the base plate 410 during adjustment between the closed, the extended, and the reclined positions.

Additionally, the seat-mounting link 400 includes an aperture 402 configured to receive a drive tube 300. In particular, the drive tube 300 includes extending ends 302, each formed to protrude through a respective aperture 402 of a respective seat-mounting link 400. In embodiments, one of the extending ends 302 is rotatably coupled to the base plate 410 enabling the drive tube 300 to revolve about a central longitudinal axis (not shown) defined thereby.

Base plate 410 is typically fixedly mounted to a chassis and/or held in position by a set of crossbeams that span between the base plate 410 and a corresponding base plate of an mirror-image linkage assembly. In embodiments, the set of crossbeams are square metal tubing that attach to a lower edge 412 of the base plate 410. Generally, the base plate 410, the seat-mounting link 400, and the plurality of links that comprise the linkage mechanism 100 are formed from metal stock, such as stamped, formed steel. However, it should be understood and appreciated that any suitable rigid or sturdy material known in the furniture-manufacturing industry may be used as well.

Recliner mechanism 500 includes back mounting bracket 510, a back drive link 520, and a front lift assembly 550. Generally, recliner mechanism 500 is adapted to recline the backrest 25 (see FIGS. 1-4) rearward while translating the seat-mounting link 400 upward and forward over the base plate 410. Accordingly, the zero-wall clearance capability is achieved. The components and operation of the recliner mechanism is discussed more fully below with reference to FIGS. 13 and 14. Seat-adjustment mechanism 700 includes several links, as discussed more fully below, and a roller system 750. Generally, the seat-adjustment mechanism 700 facilitates translating the seat-mounting link 400 in a substantially straight-line path above the base plate 410.

Figure 6:
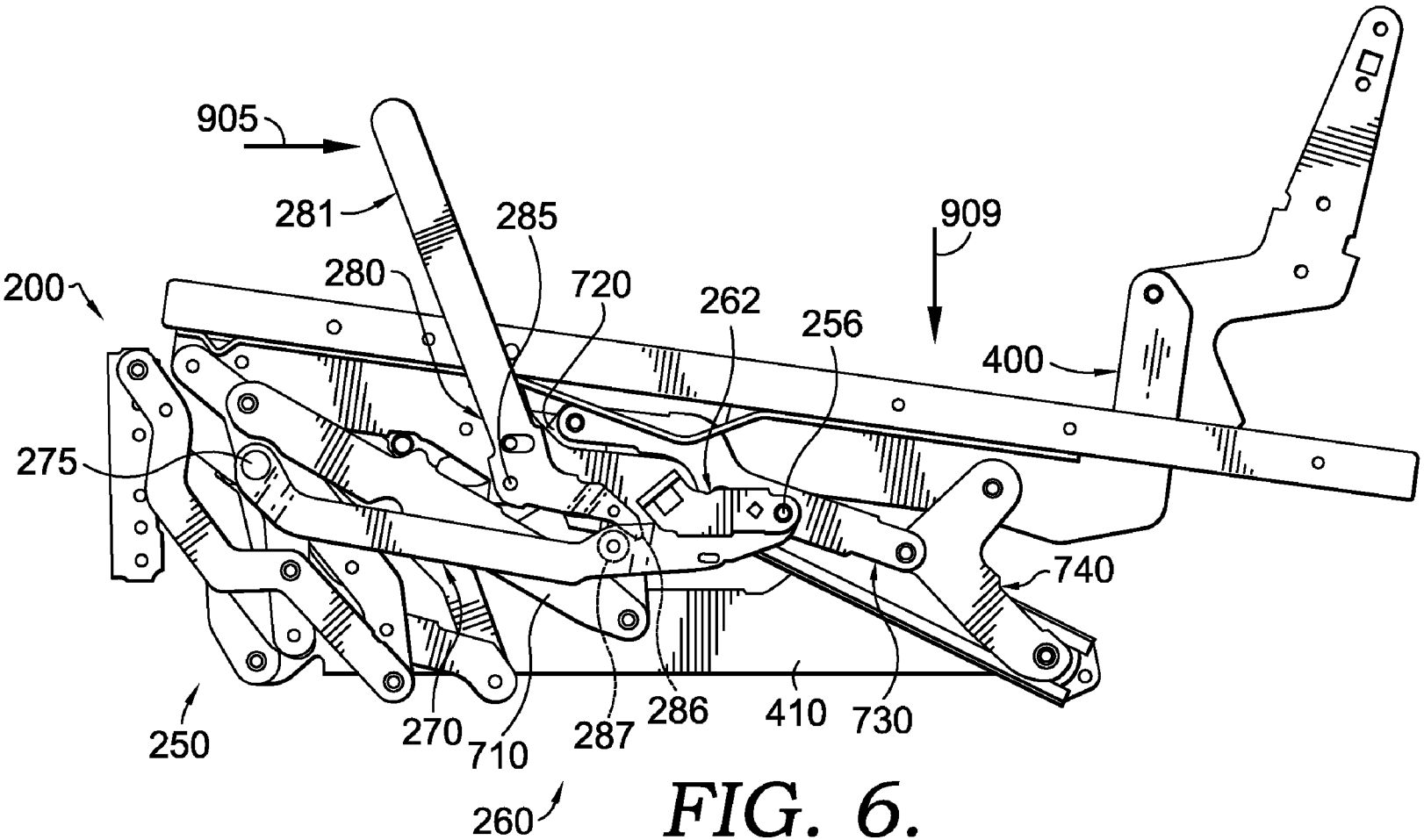
FIG. 6 is a side elevation view from an external perspective of a linkage mechanism in a closed position, in accordance with an embodiment of the present invention.
Figure 7:
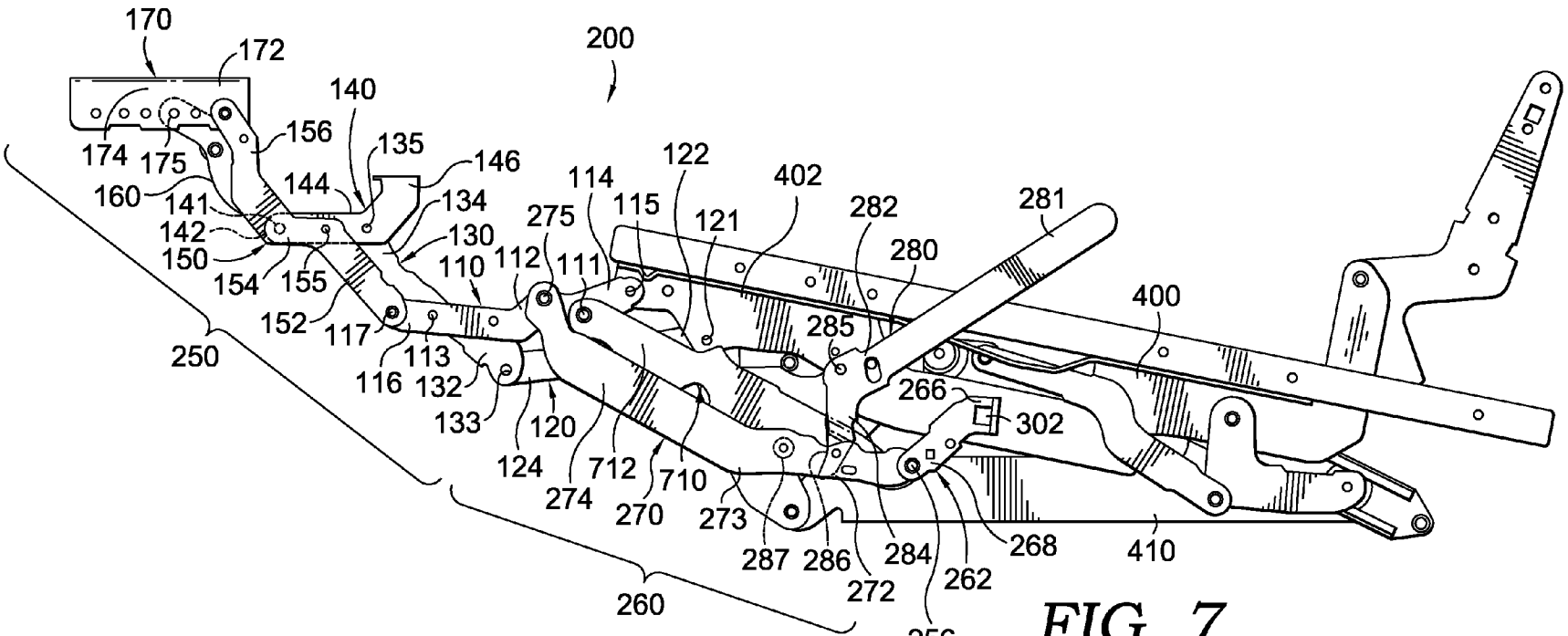
FIG. 7 is a view similar to FIG. 6, but in an extended position, in accordance with an embodiment of the present invention.
Figure 8:
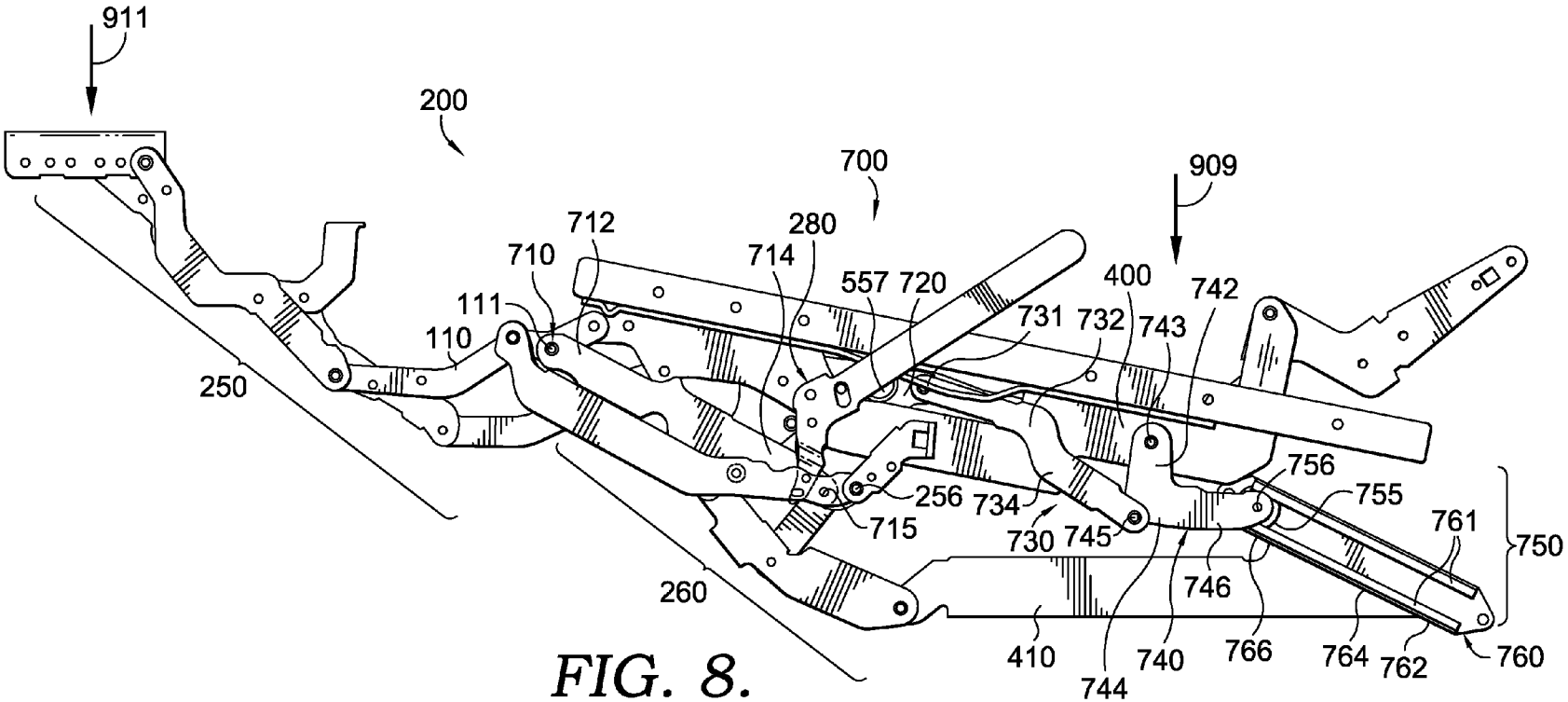
FIG. 8 is a view similar to FIG. 6, but in a fully reclined position, in accordance with an embodiment of the present invention.

With reference to FIGS. 6-8, the footrest mechanism 200 will now be discussed. As described above, the footrest mechanism 200 includes the ottoman assembly 250 and the actuation assembly 260. As best shown in FIG. 7, the actuation assembly 260 includes a footrest lock bracket 262, a footrest lock link 270, and an actuator plate 280. Footrest lock bracket 262 includes a first end 266 that is fixedly attached to the extending end 302 of the drive tube 300 (see FIG. 5), and a second end 268 that is pivotably coupled to a rearward end 272 of the footrest lock link 270. The pivotable couple is made at pivot location 256 and is discussed more fully below with reference to FIGS. 9 and 10. Footrest lock link 270 includes the rearward end 272 pivotably coupled to the footrest lock bracket 262, and a forward end 274 pivotably coupled at pivot 275 to a mid portion 112 of a front ottoman link 110 of the ottoman assembly 250. Actuator plate 280 includes an upper end 282, a mid portion 284 rotatably coupled to the seat-mounting link 400 at pivot 285, and a lower contact edge 286. As depicted in FIGS. 6-8, a handle portion 281 extends from the upper end 282 of the actuator plate 280, where the handle portion 281 is configured to receive an actuation from an occupant to adjust the seating unit from the closed position to the extended position. As will be demonstrated below, various other configurations (besides the handle portion 281) may be provided to receive an actuation from an occupant.

In embodiments, the footrest lock link 270 further includes a mid portion 273 that has a stop element 287 disposed thereon. The stop element 287 is formed to extend from the footrest lock link 270 such that the lower contact edge 286 of the actuator plate 280 is adapted to contact the stop element 287 during adjustment of the seating unit from the closed position (FIG. 6) to the extended position (FIG. 7).

As seen in FIG. 7, ottoman assembly 250 includes the front ottoman link 110, a rear ottoman link 120, a third ottoman link 130, a mid-ottoman bracket 140, first ottoman link 150, a second ottoman link 160, and a footrest bracket 170. Front ottoman link 110 includes a first end 114 rotatably coupled to a front portion 402 of the seat-mounting link 400 at pivot 115. Further, the front ottoman link 110 includes the mid portion 112 pivotably coupled to the forward end 274 of the footrest lock link 270 at the pivot 275, the third ottoman link 130 at pivot 113, and a forward end 712 of a footrest drive link 710 at pivot 111. The front ottoman link 110 also includes a second end 116 pivotably coupled to a lower end 152 of the first ottoman link 150 at pivot 117. Rear ottoman link 120 includes a first end 122 rotatably coupled to the front portion 402 of the seat mounting link 400 at pivot 121, and a second end 124 pivotably coupled to a lower end 132 of the third ottoman link 130 at pivot 133. In an exemplary embodiment, pivot 121 of the rear ottoman link 120 is located rearward in relation to the pivot 115 of the front ottoman link 110.

Figure 13:
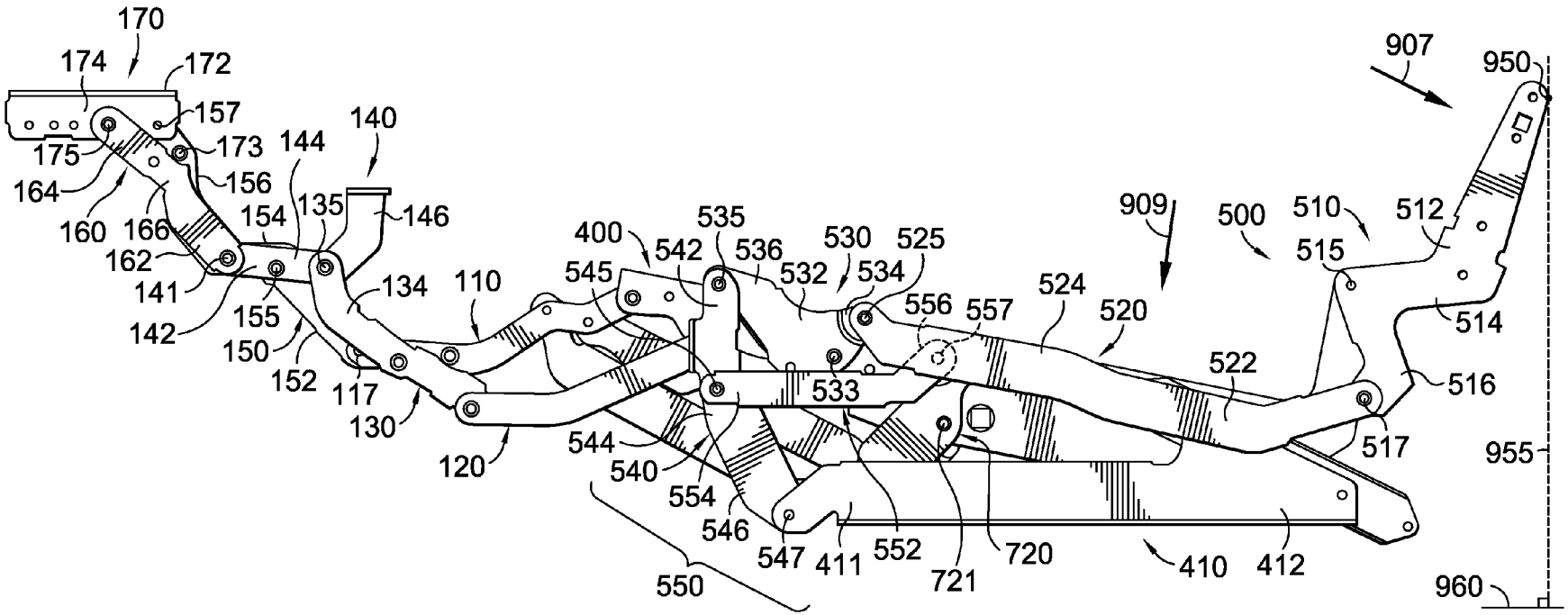
FIG. 13 is a side elevation view from an internal perspective of the linkage mechanism in an extended position, in accordance with an embodiment of the present invention.

Third ottoman link 130 includes the lower end 132 pivotably coupled to the second end 124 of the rear ottoman link 120 at the pivot 133, and an upper end 134 pivotably coupled to a mid portion 144 of the mid-ottoman bracket 140 at pivot 135. As best depicted in FIG. 13, the mid-ottoman bracket 140 includes a straight end 142 pivotably coupled to a lower end 162 of the second ottoman link 160 at pivot 141, the mid portion 144 is rotatably coupled to a mid portion 154 of the first ottoman link 150 at pivot 155 and pivotably coupled to the upper end 134 of the third ottoman link 130 at the pivot 135 (discussed above), and an angled end 146 that is typically connected to a stabilizer tube (not shown) that spans between the ottoman assembly 250 and an opposed ottoman assembly. The stabilizer tube may assist supporting the leg-support ottoman 47 (see FIGS. 1-4).

With reference to FIGS. 7 and 13, the first ottoman link 150 includes the lower end 152 pivotably coupled to the second end 116 of the front ottoman link 110 at the pivot 117, the mid portion 154 pivotably coupled to the mid portion 144 of the mid-ottoman bracket 140 at the pivot 155, and an upper end 156 pivotably coupled to a first end 172 of the footrest bracket 170 at pivot 157 and includes a stop element 173. In operation, the stop element 173 contacts a mid portion 166 of the second ottoman link 160 when the seating unit is adjusted to the extended position thereby resisting further extension of the ottoman assembly 250. Second ottoman link 160 includes a lower end 162 pivotably coupled to the straight end 142 of the mid-ottoman bracket 140 at the pivot 141, an upper end 164 pivotably coupled to a mid portion 174 of the footrest bracket 170 at pivot 175, and the mid portion 166 that may contact the stop element 173.

Footrest bracket 170 includes the first end 172 rotatably coupled to the upper end 156 of the first ottoman bracket 150 at the pivot 157, and the mid portion 174 pivotably coupled to the upper end 164 of the second ottoman link 160 at the pivot 175. In an exemplary embodiment, the footrest bracket 170 assists in supporting the first foot-support ottoman 45 (see FIGS. 1-4) and is typically disposed in a generally horizontal orientation when in the extended position and the reclined position.

The operation of the footrest mechanism 200 will now be discussed with reference to FIGS. 6-8. Initially, occupant initiates an adjustment from the closed position (FIG. 6) to the extended position (FIG. 7). In an exemplary embodiment the occupant may exert a manual rearward force 905 on the handle portion 281. In other embodiments the actuation may be a force exerted on a release lever of a cable actuator, discussed below with reference to FIGS. 11 and 12, or the actuation may be a control signal conveyed to a motor, discussed below with reference to FIGS. 15-17. Rearward force 905 on the handle portion 281 creates a torque on the actuator plate 280 about pivot 285. The torque is transferred to the footrest lock link 270 upon the lower contact edge 286 of the actuator plate 280 contacting the stop element 287. This contact forwardly pushes the footrest lock link 270 as the lower contact edge 286 of the actuator plate 280 forwardly rotates about pivot 285. Accordingly, the forward push of the footrest lock link 270 triggers adjustment of the seating unit from the closed position to the extended position.

The forward push at the stop element 287 upwardly and forwardly translates the footrest lock link 270 causing a forwardly directed force at both the pivot 275 and the pivot location 256. Unlike traditional 4-bar extension mechanisms, the lateral force provided by the user is directed to the front ottoman link 110, as opposed to a rear link. Thus, this configuration enables a significant extension of the ottoman assembly 250, but also, a compact collapsed size of the ottoman assembly 250 when in the closed position. This compact collapsed size enables the ottoman assembly 250 to be located below the seating support surface and above a lower surface of at least one crossbeam (discussed above) when in the closed position. By folding into this compact collapsed size, the ottoman assembly 250 is hidden within a chassis, or stationary base, of the seating unit. As such, a furniture designer can supply the seating unit with high legs, so that the seating unit resembles a traditional chair, or can lower the chassis of the seating unit to the underlying surface without creating an interference when adjusting the ottoman assembly 250. Because the ottoman assembly is hidden in the closed position, both the configurations discussed above are aesthetically pleasing as well as functional.

The force at the pivot location 256 pulls the second end 268 of the footrest lock bracket 262 forward thereby rotating the drive tube 300 (see FIG. 5) clockwise. Footrest lock link 270 is drivably coupled to the front ottoman link 110 at pivot 275 such that forward and upward translation of the footrest lock link 270 initiates movement of the ottoman assembly 250 from the closed position to the extended position. That is, the front ottoman link 110 is rotated forward about the pivot 115 causing the ottoman assembly 250 to extend. Front ottoman link 110 is pivotably coupled to the rear ottoman link 120 by the third ottoman link 130. Accordingly, forward rotation of the front ottoman link 110 affects forward rotation of the rear ottoman link 120 about the pivot 121. Generally, as a result of the configuration of the pivots 133 and 113, the front ottoman link 110 and the rear ottoman link 120 rotate in substantial parallel-spaced relation. The rotation of the front ottoman link 110 and the rear ottoman link 120 generate upward movement of the first ottoman link 150 and the third ottoman link 130, respectively. The first and third ottoman links 150, 130, operate in conjunction to raise and rotate the mid-ottoman bracket 140 to a generally horizontal orientation during their upward movement. The rotation of the mid-ottoman bracket 140 about pivot 155 produces upward movement of the second ottoman link 160 via the pivot 141. The first and second ottoman links 150, 160, operate in conjunction to raise and rotate the footrest bracket 170 to a generally horizontal orientation during their upward movement. Accordingly, the first foot-support ottoman 45 (see FIGS. 1-4) supported by the footrest bracket 170 is movable from a position below the seat support surface to an extended, horizontally-orientated position. Retraction of the ottoman assembly is discussed below with reference to the seat-adjustment mechanism 700 of FIG. 8.

Figure 9:
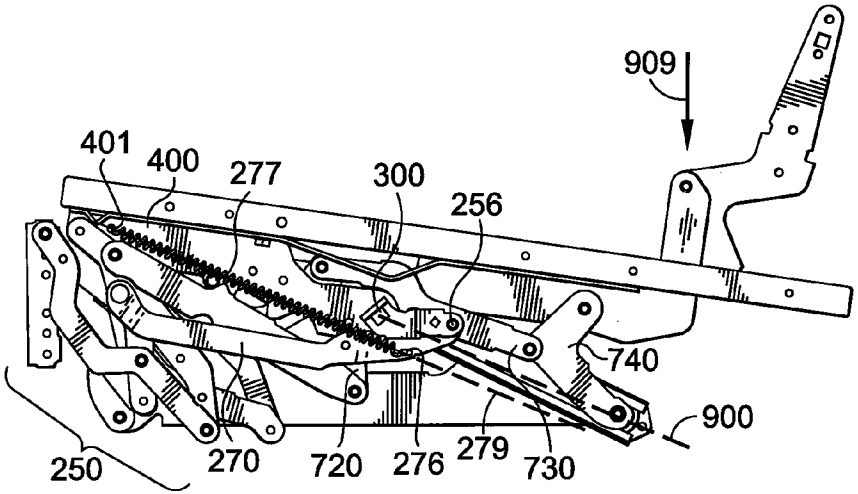
FIG. 9 is a view similar to FIG. 6, but with an extension-resistive device and showing an over-center axis, in accordance with an embodiment of the present invention.
Figure 10:
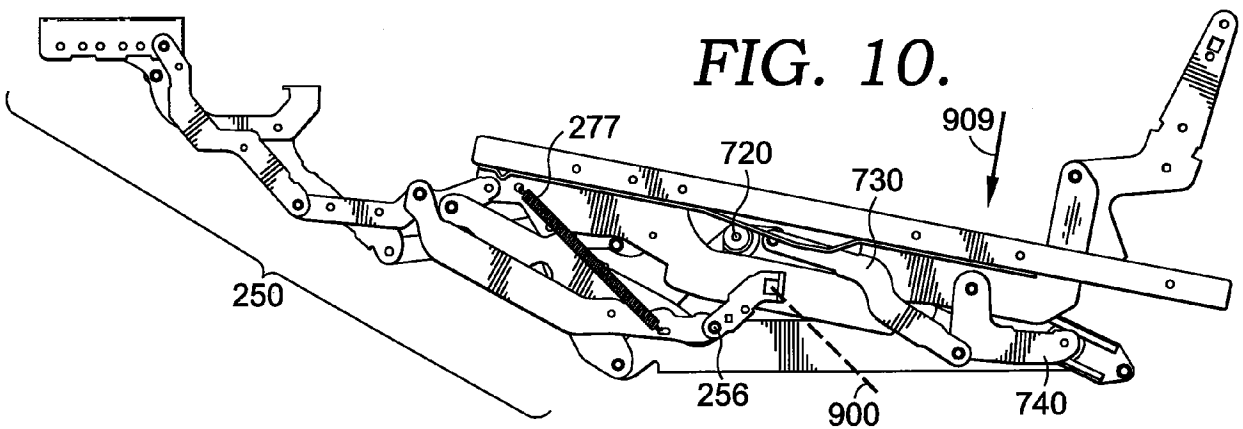
FIG. 10 is a view similar to FIG. 9, but in the extended position, in accordance with an embodiment of the present invention.

Referring now to FIGS. 9 and 10, an extension-resistive device 277 and an over-center axis 900 is illustrated, in accordance with an embodiment of the present invention. Extension-resistive device 277 may be any device that creates a compressive force between two points. In an exemplary embodiment, the extension-resistive device 277 is an extension spring. Typically, the extension-resistive device 277 is connected at one end to an aperture 401 in the seat-mounting link 400, and connected at another end to an aperture 276 in the footrest lock link 270. Accordingly, the extension-resistant device 277 interconnects the seat-mounting link 400 to the footrest lock link 270 is a resistive relationship. In addition, the extension-resistive device 277 defines a longitudinal extension-control axis 279.

Over-center axis 900 is a theoretical line derived from the direction of compressive force generated by the extension-resistant device 277. Over-center axis 900 radially extends from the central longitudinal axis of the drive tube 300 and resides in perpendicular-spaced relation therewith. In addition, the over-center axis 900 is disposed in parallel-spaced relation to the extension-control axis 279 defined by the extension-resistant device 277. Generally, the extension-resistive device 277 resists motion of the ottoman assembly 250 in the extended position of FIG. 10, and assists in collapsing the ottoman assembly 250 to the closed position of FIG. 9 incident to the pivot location 256 passing rearwardly across the over-center axis 900. Alternatively, the extension-resistive device 277 resists motion of the ottoman assembly 250 in the closed position of FIG. 9, and assists in extending the ottoman assembly 250 to the extended position of FIG. 10 incident to the pivot location 256 passing forwardly across the over-center axis 900.

Returning to FIG. 8, the seat-adjustment mechanism 700 will now be discussed in accordance with an embodiment of the present invention. As discussed above, the seat-adjustment mechanism 700 provides for straight-line translation of the seat-mounting link 400 over the base plate 410, and includes the footrest drive link 710, the bell crank 720, a rear control link 730, a rear pivot link 740, and a roller system 750. In particular, the footrest drive link 710 includes the forward end 712 pivotably connected to the front ottoman link 110 of the ottoman assembly 250 at the pivot 111, and a rearward end 714 pivotably connected to the bell crank 720 at pivot 715. Bell crank 720 is rotatably coupled to seat-mounting link 400 at pivot 721 (see FIG. 13). In addition, the bell crank 720 is pivotably coupled to a forward end 732 of the rear control link 730 at pivot 731 and a front control link 552 (see FIG. 13) at pivot 557. Returning to FIG. 8, the rear control link 730 includes a forward end 732 pivotably coupled to the bell crank 720 at the pivot 731 and a rearward end 734 pivotably coupled to a forward portion 744 of the rear pivot link 740 at pivot 745. Rear pivot link 740 is a generally L-shaped plate that includes an upper end 742 rotatably coupled to the seat-mounting link 400 at pivot 743, the forward portion 744 pivotably coupled to the rear control link 730 at the pivot 745, and a rearward end 746 that is operably coupled to the roller system 750 at pivot 756.

In embodiments, the roller system 750 is configured to translate the seat-mounting link 400 over the base plate 410 during adjustment between the closed position, the extended position, and the reclined position while maintaining a consistent inclined orientation relationship therebetween. As such, the seating support surface (discussed above) is biased at a particular inclination angle throughout adjustment. Generally, the roller system 750 includes a wheel 755, and an inclined track 760. Wheel 755 is rotationally disposed about the pivot 756 at the rearward end 746 of the rear pivot link 740. In addition, the wheel 755 is rollably engaged to the inclined track 760. In one embodiment, rollable engagement includes fitting the wheel 755 within a pair of longitudinal slots 761 incorporated within the inclined track 750 such that the slots 761 both guide and retain the wheel 755. Inclined track 760 is fixedly attached to the base plate 410 and is typically disposed in an inclined orientation. In one instance, the inclined orientation defines a trajectory of a straight-line motion path of the seat-mounting link 400 during translation.

Additionally, the inclined track 760 includes a rear portion 762, a mid portion 764, and a front portion 766. Accordingly, when the seating unit is adjusted to the closed position, the wheel 755 is located within the rear portion 762. When in the extended position, the wheel 755 is located in the mid portion 764. And, when in the reclined position, the wheel 755 is located in the front portion 766.

In operation, as seen in FIG. 8, upon moving the pivot location 256 forwardly across the over-center axis 900 (see FIGS. 9 and 10), typically caused by rotation of the actuator plate 280, the seat-adjustment mechanism 700 assists in extending the ottoman assembly 250. In particular, as the occupant occupies the seat unit, occupant weight produces a substantially-vertical downward force 909 on the seat-mounting link 400 that is transferred to the rear pivot link 740. Rear pivot link 740 is rotatable about the pivot 743 on the seat-mounting link 400, and is supported by the pivot 756 at the wheel 755. Accordingly, the downward force 909 produces a counter-clockwise torque at the rear pivot link 740, which rearwardly pulls the rear control link 730. This rearward pull is transferred to the bell crank 720 causing a forward rotation at the pivot 715 which forwardly and upwardly translates the footrest drive link 710. The translation of the footrest drive link 710 acts on the pivot 111 located on the front ottoman link 110, thereby driving the ottoman assembly 250 to the extended position.

Conversely, as seen in FIGS. 6-8, adjustment from the extended position to the closed position is initiated by a manual downward force 911 on a first foot-support ottoman (not shown) that is distributed to the footrest bracket 170. In a manner that is reverse to the steps discussed above with reference to operation of the footrest mechanism 200, the manual downward force 911 on the footrest bracket 170 causes the links 110, 120, 130, 150, and 160 to move downwardly and/or rotate in a counter-clockwise direction. Also, the brackets 140 and 170 are lowered and rotated in counter-clockwise fashion such that the ottomans 45 and 47 (see FIGS. 1-4) are adjusted from a generally horizontal orientation to a collapsed, generally-vertical orientation and are disposed beneath the seating support surface.

In addition, upon moving the pivot location 256 rearwardly (see FIGS. 9 and 10), the extension-resistant device 277 assists in collapsing the ottoman assembly 250. In particular, as discussed above, extension-resistive device 277 assists in collapsing the ottoman assembly 250 to the closed position (of FIG. 9) incident to the pivot location 256 passing rearwardly across the over-center axis 900. The downward force 909 of a seated occupant produces a torque at the rear pivot link 740 that continually promotes extending the ottoman assembly 250 to the open position. However, the collapsing force of extension-resistive device 277 overcomes this occupant-generated tendency to extend, thereby facilitating adjusting the ottoman assembly 250 to closed position.

Figure 14:
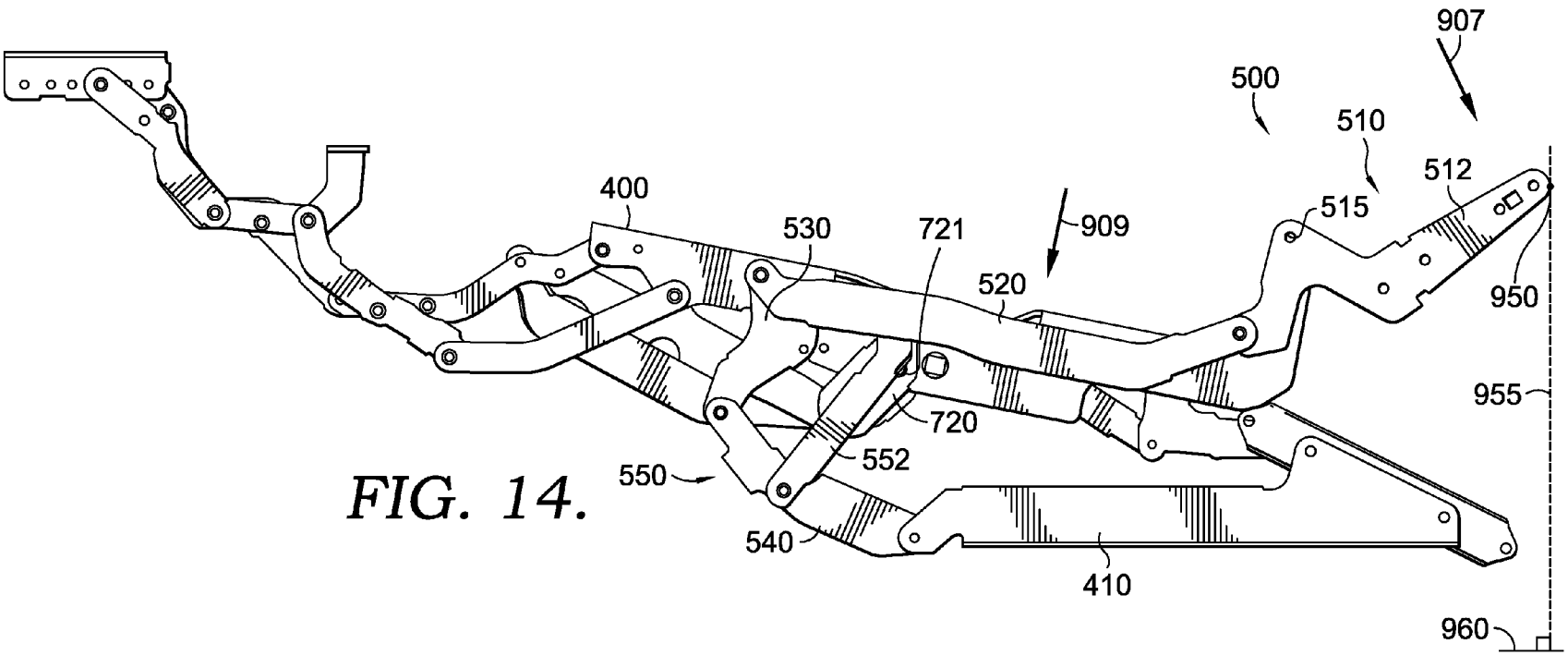
FIG. 14 is a view similar to FIG. 13, but in a fully reclined position, in accordance with an embodiment of the present invention.

Referring to FIGS. 13 and 14, the recliner mechanism 500 will now be discussed. FIGS. 13 and 14 depict a side elevation view from an internal perspective of the linkage mechanism 100 in an extended position (FIG. 13) and a reclined position (FIG. 14), in accordance with an embodiment of the present invention. As briefly discussed above, the recliner mechanism 500 includes the back-mounting bracket 510, the back drive link 520, and the front lift assembly 550. Generally, recliner mechanism 500 is adapted to recline the backrest 25 (see FIGS. 1-4) rearward while translating the seat-mounting link 400 upward and forward over the base plate 410. Accordingly, the zero-wall clearance capability is achieved. The zero-wall clearance is demonstrated by a theoretical wall plane 955 defined by a rearmost edge 950 of the back-mounting bracket 510 in the extended position of FIG. 13. Wall plane 955 is further defined as being perpendicular to the underlying surface 960. When the seating unit is adjusted to the reclined position of FIG. 14, the seat-mounting link 400 is translated forward and upward in relation to the base plate 410, as directed by the recliner mechanism 500, such that the rearmost edge 950 is located forward of the wall plane 955.

In particular, the back-mounting bracket 510 includes a back-support section 512 for receiving a rearward occupant force 907, a mid portion 514 that is rotatably coupled to the seat-mounting link 400 at pivot 515, and a drive section 516 pivotably coupled to rearward end 522 of the back drive link 520 at pivot 517. Back drive link 520 includes the rearward end 522 coupled to the back-mounting bracket 510 at the pivot 517, and a forward end 524 pivotably coupled to a first end 534 of a front lift link 530 (of the front lift assembly 550) at pivot 525. Front lift assembly 550 generally includes the front lift link 530, a front pivot link 540, and a front control link 552. Front lift link 530 includes a mid portion 532 rotatably coupled to the seat-mounting link 400 at pivot 533, the first end 534 pivotably coupled to the back drive link 520 at the pivot 525, and a second end 536 pivotably coupled to a first end 542 of the front pivot link 540 at pivot 535. Front pivot link 540 includes the first end 542 pivotably coupled to the front lift link 530 at the pivot 535, a mid portion 544 pivotably coupled to a first end 554 of the front control link 552 at pivot 545, and a second end 546 rotatably coupled to a forward end 411 of the base plate 410 at pivot 547. Front control link 552 includes the first end 554 pivotably coupled to the front pivot link 540 at the pivot 545, and a second end 556 pivotably coupled to the bell crank 720 at pivot 557.

With continued reference to FIGS. 13 and 14, the operation of the recliner mechanism 500 will be discussed, in accordance with an embodiment of the present invention. Initially, the operator-initiated, rearward occupant force 907 is received at back-support section 512 of the back-mounting bracket 510. In one embodiment, the rearward occupant force 907 should overcome a balance threshold in order to rearwardly bias the back-mounting bracket 510 thereby enabling movement from the extended position (FIG. 13) to the reclined position (FIG. 14). Essentially, the balance threshold is defined by a ratio of the rearward occupant force 907 on the backrest and the downward occupant weight 909 on the seat. That is, the downward occupant weight 909 forces the seat-mounting bracket 400 down, while the rearward occupant force 907 forces the seat-mounting bracket 400 up via the interconnection of the back-mounting bracket 510, the back drive link 520, the front lift assembly 550, and the base frame 410. Incident to overcoming the balance threshold (e.g., by the occupant leaning backward), the rearward occupant force 907 rearwardly rotates the back-mounting bracket 510. The rearward rotation generates a torque about the pivot 515. The torque is converted to a forward laterally-directed force through the back drive link 520. As such, the back drive link 520 acts as a single element that serves to transfer the laterally-directed force between the back-mounting bracket 510 and the front-lift assembly 550. In particular, the back drive link 520 creates a counter-clockwise torque on the front lift link 530 about the pivot 533. Front lift link 530 converts the counter-clockwise torque to a downward force directed through the front pivot link 540, which rotates about the forward end 411 of the base plate 410. This rotation enables the seat-mounting link 400 to be translated forward and upward in relation to the base plate 410 during adjustment from the extended position to the reclined position. That is, the seat remains biased in the inclination angle with respect to the chassis throughout adjustment.

In embodiments, the front-lift assembly 550 further includes a front control link 552 that controls the rotation of the front pivot link 540 about pivot 545. In particular, the front control link 552 includes the first end 554 pivotably coupled to the front pivot link 540, and the second end 556 pivotably coupled to the bell crank 720. The ends 554 and 556 establish a length of the front control link 552. During adjustment between the extended position to the reclined position, the length determines a distance of the upward translation of the seat-mounting link 400 in relation to the base plate 410.

Upon relieving the rearward occupant force 907 on the back-mounting bracket 510 below a balance threshold (e.g., by the occupant leaning forward), the back-mounting bracket 510 is allowed to forwardly bias. In particular, the downward occupant weight 909 causes the front pivot link 540 to push forward on the front lift link 530 creating clockwise rotation thereof. The clockwise rotation transfers a rearward laterally-directed force through the back-drive link 520 that acts to rotate the back-mounting bracket 510 in a counter-clockwise manner. That is, the laterally-directed force applied by the back-drive link 520 enables moving the back-mounting bracket 510 forward to a substantially upright orientation. In one instance, a stop spacer (not shown) extending from the front lift link 530 resists continued rotation of the front lift link 530, upon contacting the seat-mounting link 400; thus, further forward inclination of the backrest when in the closed or the extended position is contained.

Figure 11:
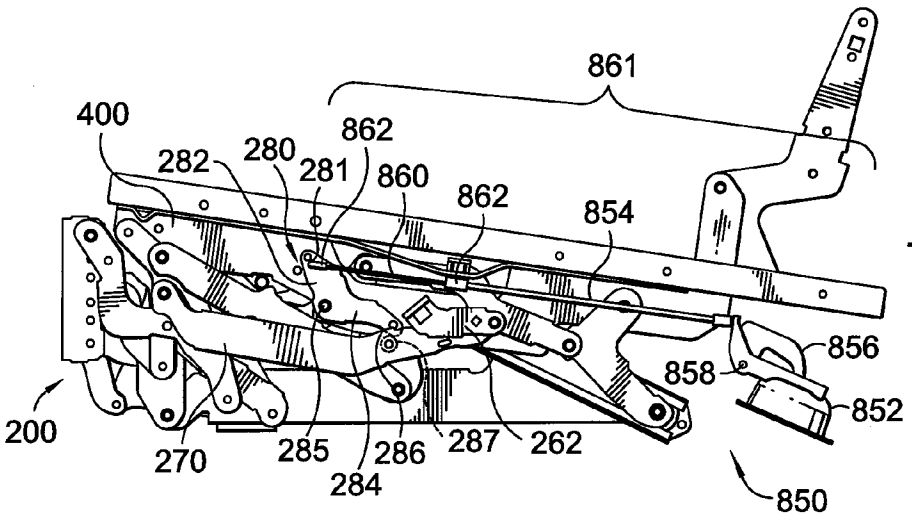
FIG. 11 is a view similar to FIG. 6, but with a cable actuator assembly, in accordance with an embodiment of the present invention.
Figure 12:
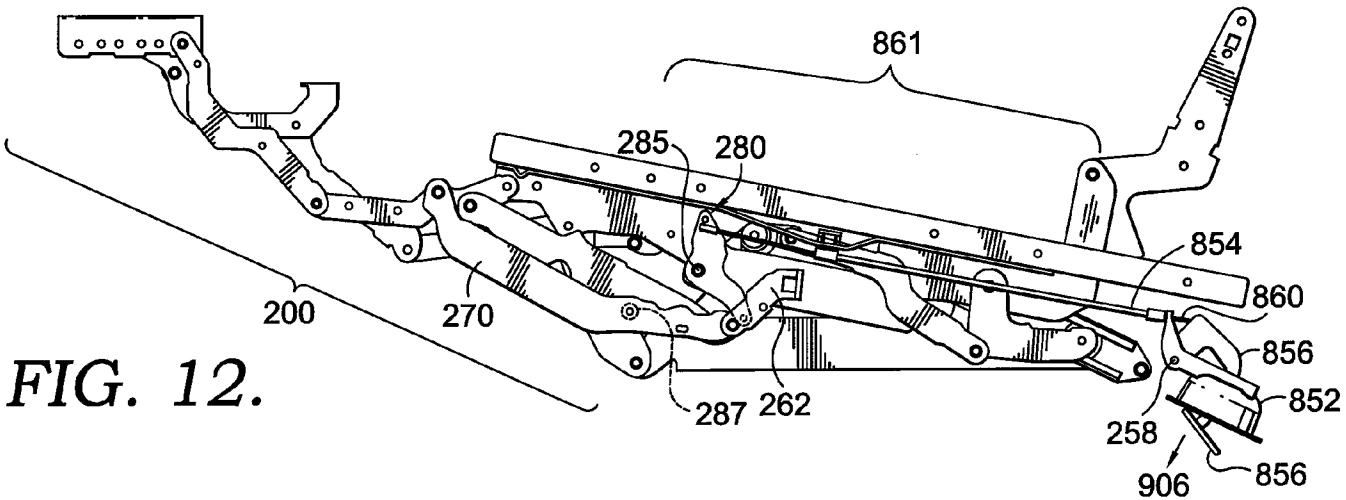
FIG. 12 is a view similar to FIG. 11, but in an extended position, in accordance with an embodiment of the present invention.

As shown in FIGS. 11 and 12, another embodiment for creating the actuation at the actuator plate 280 will now be discussed. This embodiment includes is a cable actuator assembly 850. Cable actuator assembly 850 includes a handle bracket 852, a release handle 856, a pivot pin 858, and a cable assembly 861. Handle bracket 852 and release handle 856 are pivotably coupled by the pivot pin 858. Cable assembly 861 has a conduit 854, and a cable wire 860 with an actuation end 862 extending from the conduit 854 and fastened to an aperture 281 of the actuator plate 280. Cable wire 860 is allowed to move axially within the conduit 854 as is known to those of skill in the art. Further, the cable wire 860 is fixedly connected to the release handle 856 such that the cable wire 861 may be manipulated by moving the release handle 856 between a resting condition (FIG. 11) and a trigger condition (FIG. 12). In embodiments, the conduit 854 is secured to the seat-mounting bracket 400 via a clamp-type fastener 862.

In use, the occupant of the seating unit may exert a pulling force 906 on the release handle 856 to adjust the recliner mechanism 500 from the closed position (FIG. 11) to the extended position (FIG. 12). Pulling the release handle 856 rotates the release handle 856 about pivot pin 858 switching from the resting condition to the trigger condition. This movement engages the cable wire 860 thereby pulling the cable wire 860 through conduit 854. This, in turn, pulls the upper end 282 of the actuator plate 280 rearward, thereby causing the lower contact edge 286 to push forward against the stop element 287 of the footrest lock link 270. As footrest lock link 270 is pushed forward, the footrest mechanism 200 is triggered to move from the closed position to the extended position, as more fully discussed above.

Although two different configurations of the actuation at the actuator plate 280 have been shown, it should be understood that other release mechanisms could be used, and that the invention is not limited to those release mechanism shown and described.

Figure 15:
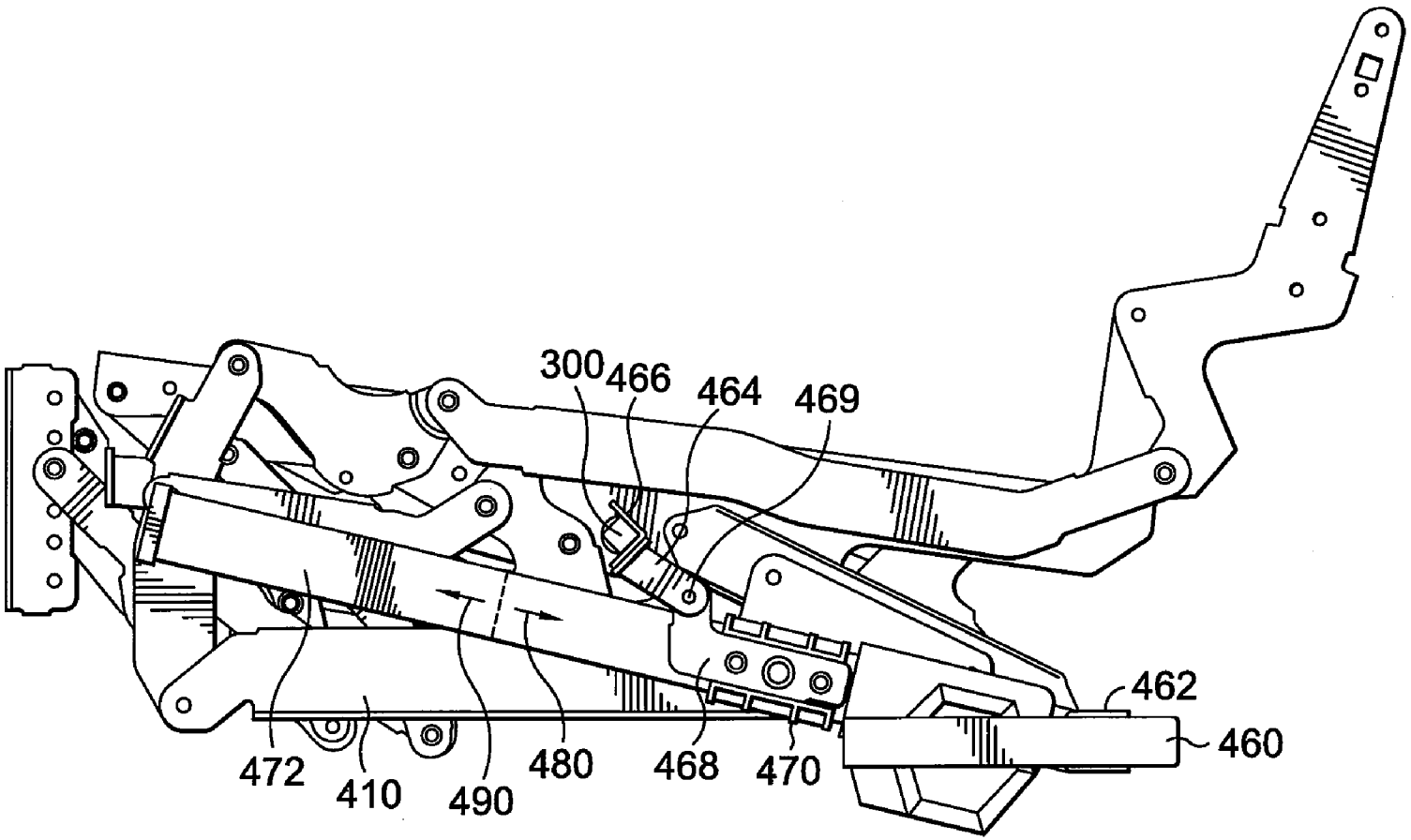
FIG. 15 is view similar to FIG. 13, but in the closed position with a motor actuator mechanism, in accordance with an embodiment of the present invention.
Figure 16:
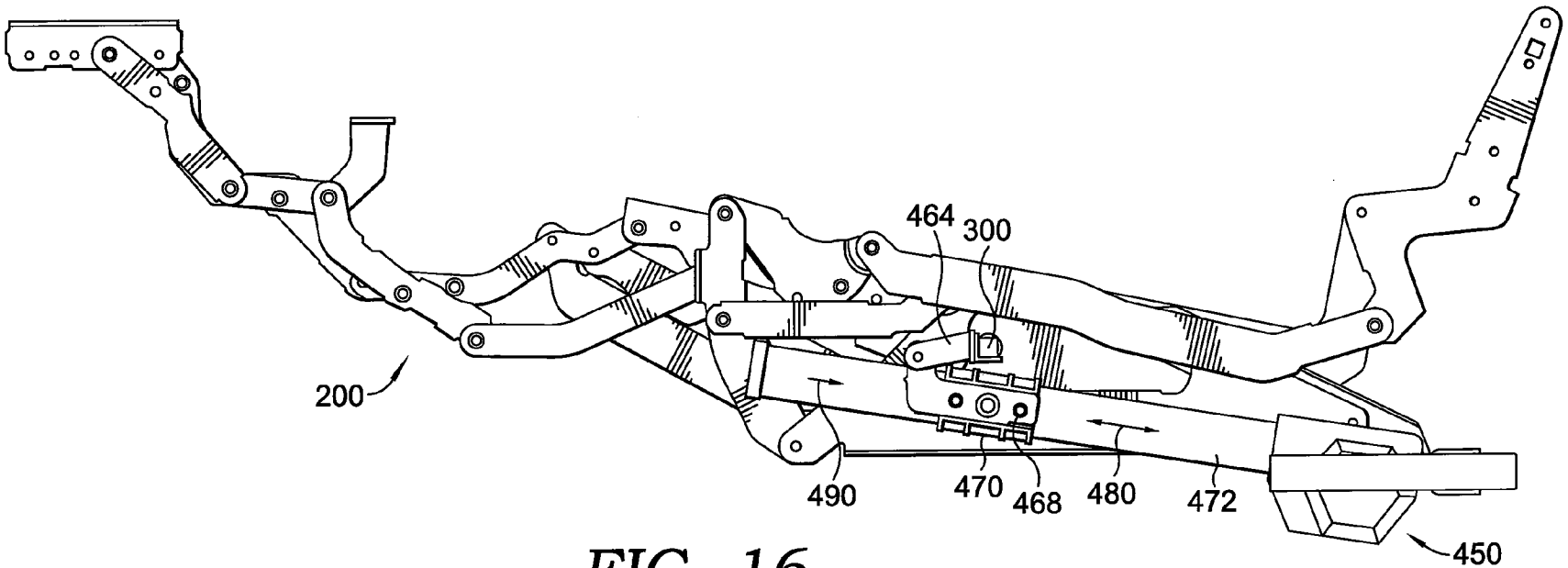
FIG. 16 is a view similar to FIG. 15, but in an extended position, in accordance with an embodiment of the present invention.
Figure 17:
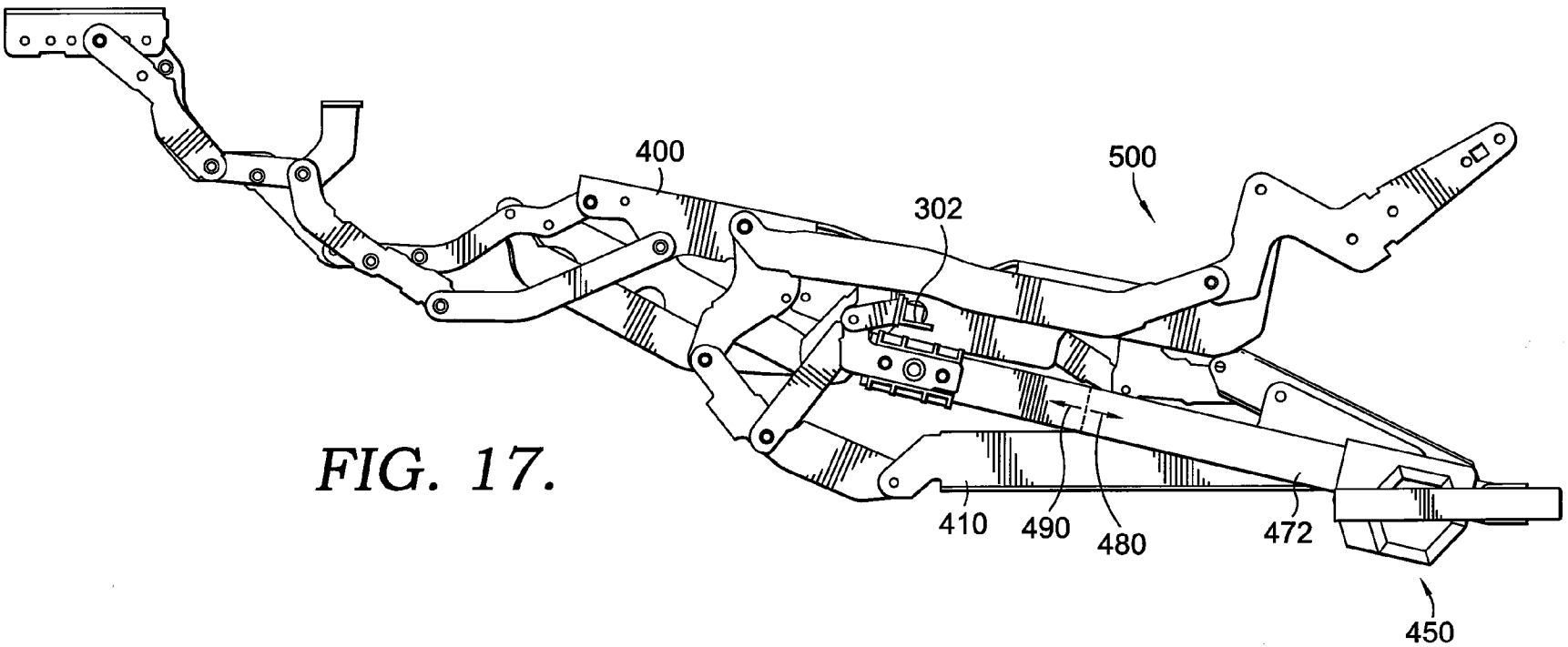
FIG. 17 is a view similar to FIG. 15, but in a fully reclined position, in accordance with an embodiment of the present invention.

Turning to FIGS. 15-17, a motor 450 for actuating the footrest mechanism 200 between the closed position (FIG. 15) and the extended position (FIG. 16), and the recliner mechanism 500 between the extended position (FIG. 16) and the reclined position (FIG. 17) is shown, in accordance with an embodiment of the present invention. The motor 450 includes an elongated member 472, a drive piece 470 that translates longitudinally over the elongated member 472 under automated control, and a pair of pivot brackets 468 fixedly attached to the drive piece 470. In an exemplary embodiment, the elongated member includes a first travel section 480 and a second travel section 490. In one embodiment, the motor 450 is pivotably coupled at a clevis-type fastener 462 to a motor-mount tube 460. In one instance, the motor-mount tube 460 is fixedly attached to the base plate 410.

Typically, the drive tube 300 is equipped with a drive-tube angle 466 attached to the drive tube 300 and a pair of L-shaped pivot brackets 464 that extend radially from the drive-tube angle 466. L-shaped pivot brackets 464 and the pivot brackets 468 are pivotably coupled a pivot 469.

In operation, the occupant may provide an automated control to the motor 450 to adjust the seating unit between the closed position and the extended position. In this instance, the motor 450 traverses the drive piece 470 along the elongated member 472 within the first travel section 480 thereof. When traversing the first travel section 480, the drive piece 470 in conjunction with L-shaped pivot brackets 468 create a torque at the pivot brackets 464 thereby rotatably adjusting the drive tube 300. The rotatable adjustment actuates the footrest lock bracket (not shown) to either extend or collapse the footrest mechanism 200, as discussed above. In the instance that the motor 450 traverses the drive piece 470 along the elongated member 472 within the second travel section 490 thereof, the recliner mechanism 500 is adjusted. When traversing the second travel section 490, the drive piece 470, in conjunction with L-shaped pivot brackets 468, create a lateral thrust at the pivot brackets 464 thereby translating the drive tube 300. The lateral thrust pushes the seat-mounting link 400 (rotatably coupled to the drive tube 300) upward and forward in relation to the base plate 410, thereby adjusting the recliner mechanism 500 to reclined position, or pulls the seat-mounting link 400 downward and rearward in relation to the base plate 410, thereby adjusting the recliner mechanism 500 to the extended position, as discussed above.

Figure 18:
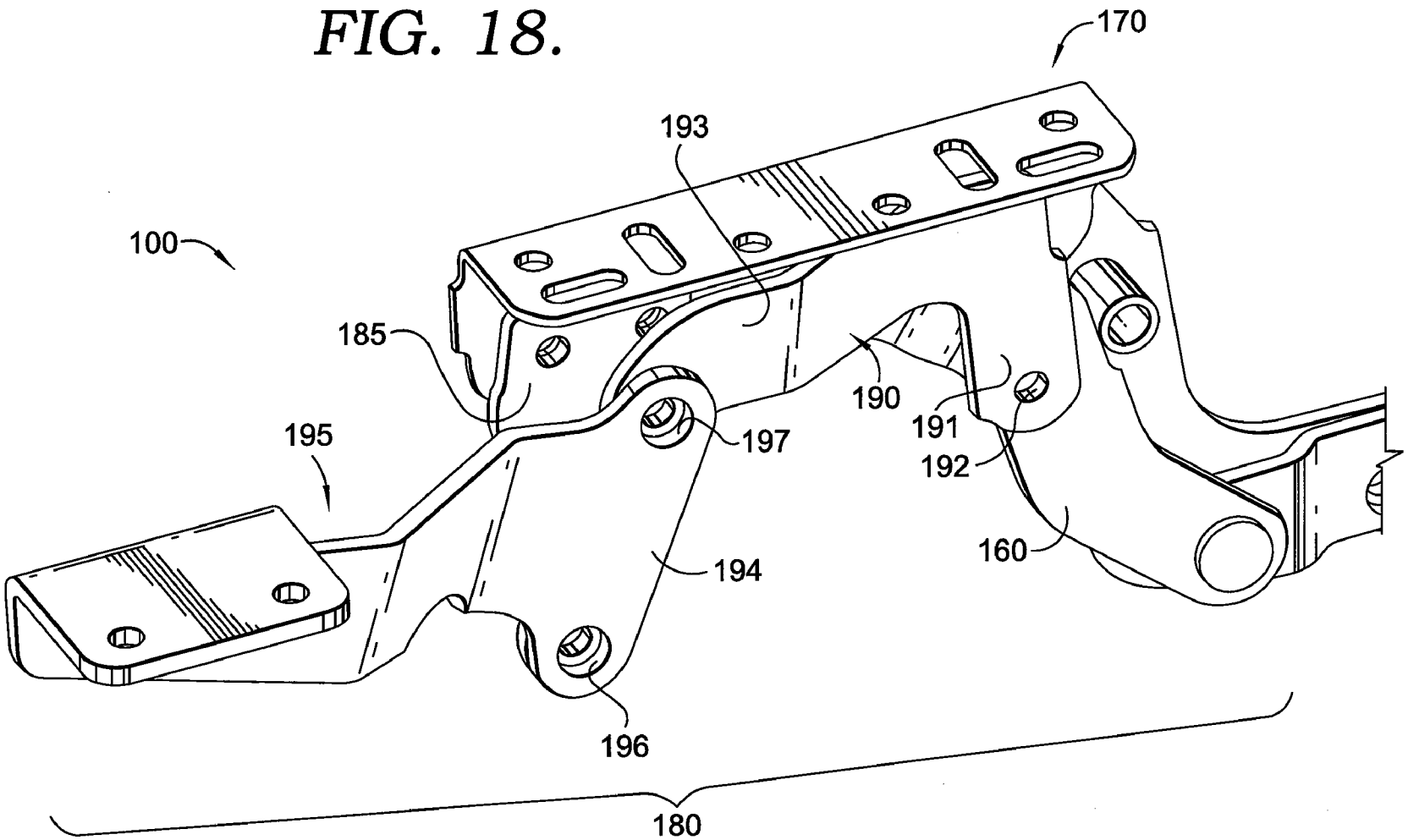
FIG. 18 is an enlarged partial side elevation view of a linkage mechanism in an extended position with a leg-extension assembly, in accordance with an embodiment of the present invention.

With reference to FIG. 18, an enlarged partial side elevation view of the linkage mechanism 100 in the extended position with a leg-extension assembly 180 is shown, in accordance with an embodiment of the present invention. Initially, the leg-extension assembly 180 includes a mounting bracket 185, a drive bracket 190, and a flipper arm 195. Mounting bracket 185 is fixedly attached to the footrest bracket 170. Drive bracket 190 includes an angled end 191 pivotably coupled to the second ottoman link 160 at pivot 192, and a straight end 193 pivotably coupled to a coupling end 194 of the flipper arm 195. Flipper arm 195 includes the coupled end rotatably coupled to the mounting bracket 185 at pivot 196, and pivotably coupled to the straight end 193 of the drive bracket 190 at pivot 197. In operation, the flipper arm 195 is rotated to a substantially horizontal orientation in the extended position. In particular, the drive bracket 190 is driven forward by the second ottoman link 160 when extending the ottoman assembly 250 from the closed position. Typically, the flipper arm 195 is adapted to carry a second foot-support ottoman (not shown) such that when the flipper arm is in the extended position (i.e., orientated in a substantially horizontal disposition) the second foot-support ottoman is generally horizontal and forward of the first foot-support ottoman 45 (see FIGS. 1-4).

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit, comprising:

a first foot-support ottoman;

a chassis that includes a pair of base plates in substantially parallel-spaced relation each having a lower edge, a forward portion and a rearward portion, and at least one crossbeam spanning the base plates and fixedly attached to the lower edge thereof;

a pair of seat-mounting links in substantially parallel-spaced relation, wherein each of the seat-mounting links is disposed in an inclined orientation in relation to the chassis;

a seating support surface extending between the seat-mounting links;

a pair of generally mirror-image linkage mechanisms each interconnecting each of the base plates and a respective seat-mounting link, and adapted to move between a closed position, an extended position, and a reclined position, wherein each of the linkage mechanism comprises:

a pair of ottoman assemblies that movably inter-couple a first foot-support ottoman to the seat-mounting links, and that extend said first foot-support ottoman forward of the chassis in said extended position; and a backrest that extends substantially upright from said seating support surface in said extended position; and a pair of roller systems adapted to translate the seat-mounting links over the base plates during adjustment between the closed position, the extended position and the reclined position while maintaining the inclined orientation relationship therebetween such that the seating support surface is biased at a particular inclination angle throughout adjustment.

2. The seating unit of claim 1, wherein the ottoman assembly includes a set of linkages that collapse to the closed position such that the set of linkages are located below the seating support surface and above a lower surface of the at least one crossbeam.

3. The seating unit of claim 1, further comprising a pair of opposed arms each having an arm-support surface orientated substantially horizontally, wherein each of the opposed arms is operably coupled to a respective seat-mounting link such that during adjustment between the closed position, the extended position, and the reclined position, the arm-support surface of each of the opposed arms is maintained in the substantially horizontal orientation.

4. The seating unit of claim 3, further comprising a T-cushion style seat supported by the seating support surface, wherein the operable coupling of the opposed arms to the seat-mounting links prevents interference between the T-cushion style seat and the opposed arms during adjustment between the closed position, the extended position, and the reclined position.

5. The seating unit of claim 1, the pair of roller systems comprising:

a pair of rear pivot links, each pivotably coupled to a respective seat-mounting link;

a pair of inclined tracks fixedly attached to the rearward portion of a respective base plate; and a pair of wheels, each is rotationally disposed on a respective rear pivot link and is rollably engaged to a respective inclined track, wherein each inclined track defines a straight-line motion path of the seat-mounting links during translation.

6. The seating unit of claim 1, further comprising a pair of opposed arms each having an arm-support surface orientated substantially horizontally, wherein each of the opposed arms is attached to the chassis supported over an underlying surface by legs, such that during adjustment between the closed position, the extended position, and the reclined position, the arm-support surface of each of the opposed arms is maintained in the substantially horizontal orientation.

7. The seating unit of claim 1, further comprising a pair of actuation assemblies adapted to receive an occupant's actuation of adjustment from the closed position to the extended position and convert the actuation to a forward and upward translation of a pair of footrest lock links;

the pair of ottoman assemblies comprising:

a pair of rear ottoman links, each rotatably coupled to a respective seat-mounting link; and a pair of front ottoman links, each rotatably coupled to a respective seat-mounting link in a forward location of the rotatable coupling of a respective rear ottoman link, wherein each footrest lock link is drivably coupled to a respective front ottoman link such that forward and upward translation of the footrest lock link initiates movement of a respective ottoman assembly from the closed position to the extended position.

8. The seating unit of claim 7, further comprising:

a pair of footrest drive links, each drivably coupled to a respective front ottoman link;

incident to forward and upward translation of the pair of footrest lock links, the rear pivot links converting a downward occupant weight on the seating support surface to a forward translation of the drive links, thereby facilitating movement of the ottoman assemblies from the closed position to the open position.

9. The seating unit of claim 7, further comprising:

a second foot-support ottoman, wherein the pair of ottoman assemblies are movably couple the second ottoman to the seat-mounting links, wherein the pair of ottoman assemblies further comprise a pair of footrest brackets and a pair of flipper arms rotatably coupled thereto, and wherein the first foot-support ottoman spans the pair of footrest brackets and the second ottoman spans the pair of flipper arms.

* * * * *